US006261150B1

(12) United States Patent
Mizuno et al.

(10) Patent No.: US 6,261,150 B1
(45) Date of Patent: Jul. 17, 2001

(54) EYEGLASS LENS GRINDING APPARATUS

(75) Inventors: Toshiaki Mizuno; Hirokatsu Obayashi, both of Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/343,201

(22) Filed: Jun. 30, 1999

(30) Foreign Application Priority Data

Jun. 30, 1998 (JP) ..... 10-184128

(51) Int. Cl.[7] ..... B24B 49/00
(52) U.S. Cl. ..... 451/5; 451/9; 451/43
(58) Field of Search ..... 451/5, 8, 9, 240, 451/255, 256, 42, 43, 44

(56) References Cited

U.S. PATENT DOCUMENTS

| | | | | |
|---|---|---|---|---|
| Re. 35,898 | | 9/1998 | Shibata et al. . | |
| 5,138,770 | | 8/1992 | Matsuyama . | |
| 5,228,242 | | 7/1993 | Matsuyama . | |
| 5,333,412 | | 8/1994 | Matsuyama . | |
| 5,347,762 | | 9/1994 | Shibata et al. . | |
| 5,549,503 | | 8/1996 | Nauche et al. . | |
| 5,775,973 | * | 7/1998 | Watanabe | 451/5 |
| 5,904,608 | * | 5/1999 | Watanabe | 451/5 |
| 6,033,288 | * | 3/2000 | Weisshaus et al. | 451/8 |
| 6,048,258 | * | 4/2000 | Shibata | 451/277 |

FOREIGN PATENT DOCUMENTS

| | | |
|---|---|---|
| 0 839 604 | 5/1998 | (EP) . |
| 0 960 690 | 12/1999 | (EP) . |
| 3-20603 | 1/1991 | (JP) . |
| 7-44440 | 10/1995 | (JP) . |
| 10-138108 | 5/1998 | (JP) . |

* cited by examiner

*Primary Examiner*—Timothy V. Eley
*Assistant Examiner*—Dung Van Nguyen
(74) *Attorney, Agent, or Firm*—Sughrue, Mion, Zinn, Macpeak & Seas, PLLC

(57) ABSTRACT

An eyeglass lens grinding apparatus for grinding a periphery of a lens to be processed. The apparatus includes: a lens rotation shaft which holds and rotates the lens; a lens rotating device having a lens rotating motor and a first transmission member which transmits a rotational torque of the lens rotating motor to the lens rotation shaft; an abrasive wheel rotation shaft which rotates a lens grinding abrasive wheel; and an abrasive wheel rotating device having an abrasive wheel rotating motor and a second transmission member which transmits a rotational torque of the abrasive wheel rotating motor to the abrasive wheel rotation shaft. A moving device causes a relative movement between the lens rotation shaft and the abrasive wheel rotation shaft to vary an axis-to-axis distance between an rotation axis of the lens rotation shaft and an rotation axis of the abrasive wheel rotation shaft, thereby brining the lens into pressure contact with the abrasive wheel for processing. A detector detects a state of rotation of the lens or the abrasive wheel. A controller judges whether the lens has been completely processed, based on a result of detection by the detector.

11 Claims, 4 Drawing Sheets

EYEGLASS LENS GRINDING APPARATUS

BACKGROUND OF THE INVENTION

The present invention relates to an eyeglass lens grinding apparatus for grinding the periphery of an eyeglass lens.

An eyeglass lens grinding apparatus is known. After a subject lens is chucked by two lens rotating shafts, the apparatus controls the axis-to-axis distance between an axis of the lens rotating shafts and an axis of an abrasive wheel shaft of a grinding abrasive wheel on the basis of processing data while rotating the lens, thereby grinding the lens in pressure contact with the abrasive wheel. The apparatus of this type has a processing-completion detecting mechanism for detecting whether or not the entire periphery of the lens has been processed in accordance with processing data. In general, the mechanism is designed to detect, through a mechanical contact or using a sensor, whether the axis-to-axis distance between the lens rotating shafts and the abrasive wheel shaft has reached a predetermined distance based on the processing data.

In the case where the lens chucked by the two lens rotating shafts is processed by being brought into pressure contact with the abrasive wheel, the lens rotating shafts are slightly deflected due to their rigidity in a direction in which the lens rotating shafts escape from the abrasive wheel. The lens is clamped through a suction cup; however, if the rigidity of the suction cup portion is weak, the lens is also slightly deflected in the direction in which it escapes from the abrasive wheel. For this reason, the above-described processing-completion detecting mechanism determines the completion of processing at a stage where the actually ground lens is slightly larger than the intended size. This hinders the accurate processing.

As a conventional countermeasure against this problem, even after the completion of processing is detected, the lens is rotated idly until the deflection or distortion is overcome, to ensure that unprocessed portions will be processed.

However, if the number of idle rotations after detection of the completion of processing is set for the purpose of grinding all the lenses with high accuracy and such setting is made on the basis of thick lenses which are difficult to process, then excessive idle rotation (and thus wasteful processing time) is caused in the case of thin lenses even though the thin lenses have been already processed without any unprocessed portions. Conversely, if the setting of the number of idle rotations is insufficient (small), thick lenses cannot be processed with high accuracy.

SUMMARY OF THE INVENTION

In view of the above-described problems, it is an object of the present invention to provide an eyeglass lens grinding apparatus, which can accurately detect the completion of processing without any excessive idle rotation, thereby making it possible to perform high-accuracy processing.

To attain the above object, the present invention is characterized by having the following features.

(1) An eyeglass lens grinding apparatus for grinding a periphery of a lens to be processed, the apparatus comprising:

lens rotating means, having a lens rotation shaft, for holding and rotating the lens;

abrasive wheel rotating means, having an abrasive wheel rotation shaft, for rotating a lens grinding abrasive wheel;

axis-to-axis distance varying means for varying a distance between an axis of the lens rotation shaft and an axis of the abrasive wheel rotation shaft so that the lens is brought into pressure contact with the abrasive wheel for processing;

detecting means for detecting a state of rotation of the lens or the abrasive wheel;

judging means for judging whether the lens has been completely processed, based on a result of detection by the detecting means.

(2) The eyeglass lens grinding apparatus according to (1), wherein the detecting means detects a rotational torque of the lens or a rotational torque of the abrasive wheel.

(3) The eyeglass lens grinding apparatus according to (2), wherein the judging means judges whether the lens has been completely processed, based on a comparison in which the rotational torque detected by the detecting means is compared with a certain rotational torque.

(4) The eyeglass lens grinding apparatus according to (1), wherein:

the lens rotating means includes a lens rotating motor for rotating the lens rotation shaft;

the abrasive wheel rotating means includes an abrasive wheel rotating motor for rotating the abrasive wheel shaft; and the detecting means detects a rotational torque of said lens rotating motor or a rotational torque of said abrasive wheel rotating motor.

(5) The eyeglass lens grinding apparatus according to (4), wherein the detecting means detects an electric current supplied to the lens rotating motor or an electric current supplied to the abrasive wheel rotating motor to obtain the rotational torque.

(6). The eyeglass lens grinding apparatus according to (4), wherein the judging means judges whether the lens have been completely processed, based on a comparison in which the rotational torque detected by the detecting means is compared with a certain rotational torque.

(7) The eyeglass lens grinding apparatus according to (1), wherein the detecting means detects a rotational speed of the abrasive wheel or the abrasive wheel rotating shaft.

(8) The eyeglass lens grinding apparatus according to (1), wherein:

the abrasive wheel rotating means includes an abrasive wheel rotating motor, and a transmission member for transmitting a rotational torque of the motor to the abrasive wheel rotating shaft; and the detecting means detects a rotational speed of the transmission member.

(9) The eyeglass lens grinding apparatus according to (1), further comprising:

input means for inputting data on a shape of an eyeglass frame to which the lens is to be fitted, and data on a layout of the lens with respect to the eyeglass frame;

arithmetic means for obtaining lens processing data based on the data thus inputted; and control means for controlling operation of the axis-to-axis distance changing means based on the processing data thus obtained.

(10) The eyeglass lens grinding apparatus according to (1), further comprising:

control means for controlling operation of the axis-to-axis distance changing means based on a result of judgement by the judging means.

(11) An eyeglass lens grinding apparatus for grinding a periphery of a lens to be processed, the apparatus comprising:

a lens rotation shaft which holds and rotates the lens;

a lens rotating device having a lens rotating motor and a first transmission member which transmits a rotational torque of the lens rotating motor to the lens rotation shaft;

an abrasive wheel rotation shaft which rotates a lens grinding abrasive wheel;

an abrasive wheel rotating device having an abrasive wheel rotating motor and a second transmission member which transmits a rotational torque of the abrasive wheel rotating motor to the abrasive wheel rotation shaft;

a moving device which causes a relative movement between the lens rotation shaft and the abrasive wheel rotation shaft to vary an axis-to-axis distance between the lens rotation shaft and the abrasive wheel rotation shaft, thereby brining the lens into pressure contact with the abrasive wheel for processing;

a detector which detects a state of rotation of the lens or the abrasive wheel; and a controller which judges whether the lens has been completely processed, based on a result of detection by the detector.

(12) The eyeglass lens grinding apparatus according to (11), wherein the detector detects the rotational torque of the lens rotating motor or the rotational torque of the abrasive wheel rotating motor.

(13) The eyeglass lens grinding apparatus according to (12), wherein the detector detects an electric current supplied to the lens rotating motor or an electric current supplied to the abrasive wheel rotating motor to obtain the rotational torque.

(14) The eyeglass lens grinding apparatus according to (12), wherein the controller judges whether the lens has been completely processed, based on a comparison in which the rotational torque detected by the detector is compared with a certain rotational torque.

(15) The eyeglass lens grinding apparatus according to (11), wherein the detector detects a rotational speed of the abrasive wheel, the abrasive wheel rotation shaft or the second transmission member.

(16) The eyeglass lens grinding apparatus according to (11), further comprising:

an input device which inputs data on a shape of an eyeglass frame to which the lens is to be fitted, and data on a layout of the lens with respect to the eyeglass frame; and wherein the controller obtains lens processing data based on the data thus inputted, and controls operation of the moving device based on the processing data thus obtained.

(17) The eyeglass lens grinding apparatus according to (11), wherein the controller controls operation of the moving device based on the a result of judgment.

The present disclosure relates to the subject matter contained in Japanese patent application No. Hei. 10-184128 (filed on Jun. 30, 1998), which is expressly incorporated herein by reference in its entirety.

DESCRIPTION OF THE PREFERRED EMBODIMENT

Figure 1:
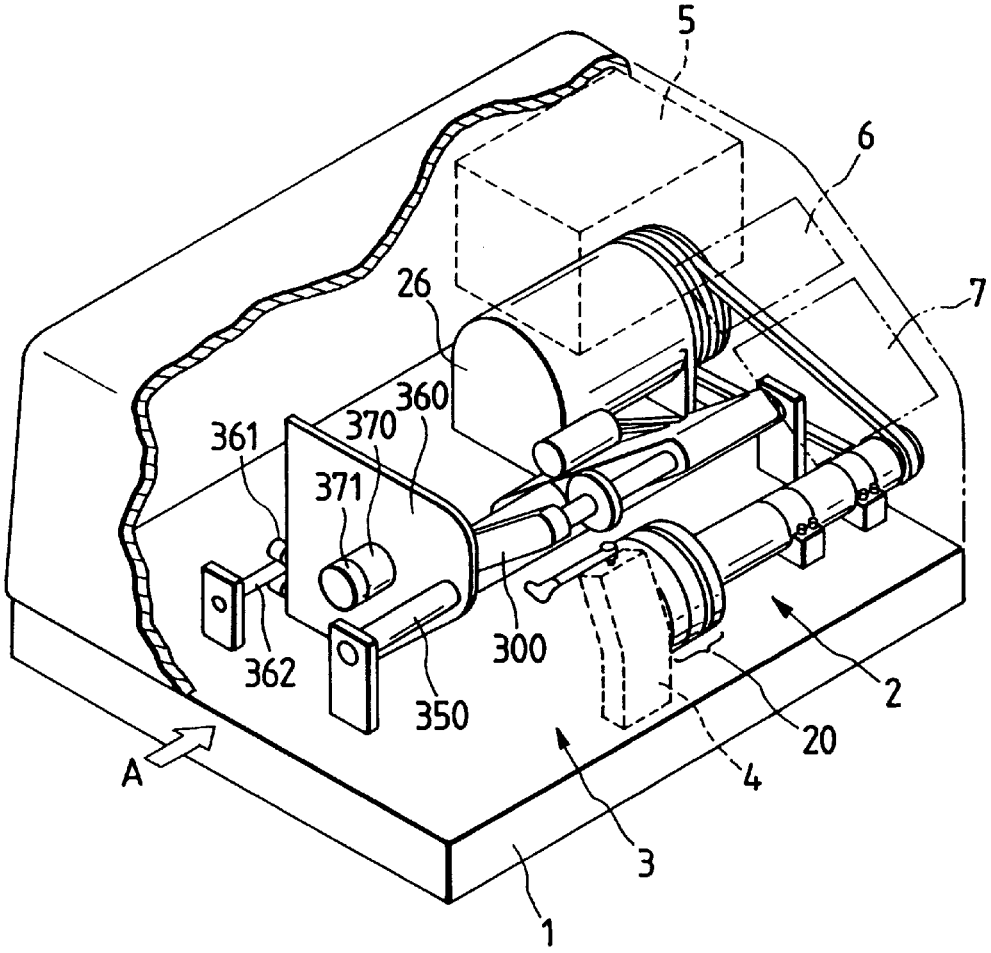
FIG. 1 is a perspective view illustrating an overall configuration of an eyeglass lens grinding apparatus in accordance with the present invention.

Referring now to the accompanying drawings, a description will be given of an embodiment of the present invention. FIG. 1 is a perspective view illustrating an overall configuration of an eyeglass lens grinding apparatus in accordance with the present invention. Arranged on a body base 1 are an abrasive-wheel rotating section 2 for rotating an abrasive wheel group 20, a carriage section 3 for bringing the subject lens clamped by two lens chuck shafts into pressure contact with the abrasive wheel group 20, and a lens-shape measuring section 4. An eyeglass-frame measuring section 5 is incorporated in an upper rear portion of the apparatus, and a display section 6 for displaying results of measurement and processing information as well as an input section 7 having various input switches are arranged on the front surface side of the apparatus casing.

Figure 2:
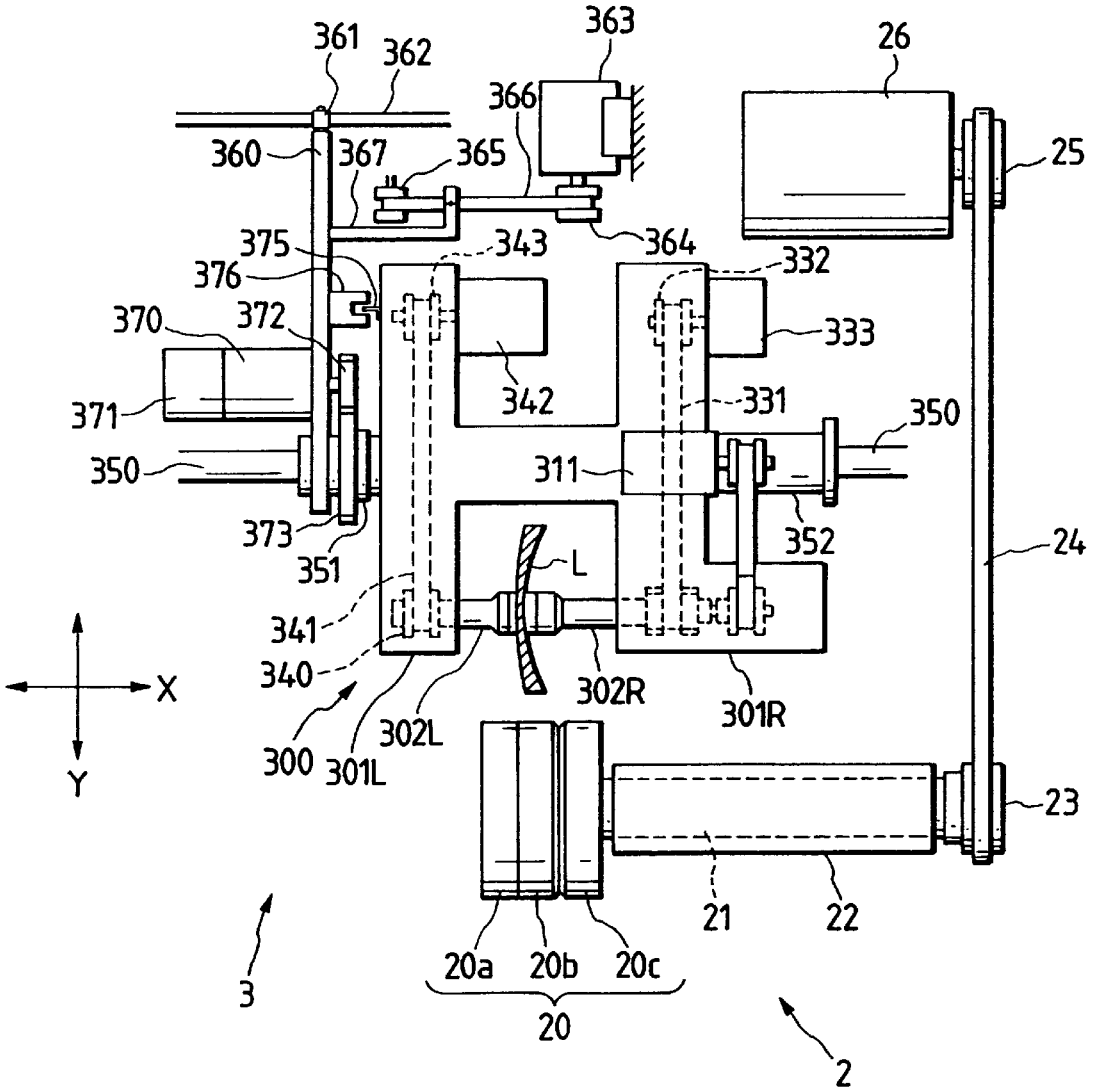
FIG. 2 is a schematic diagram illustrating the construction of an abrasive-wheel rotating section and a carriage section.
Figure 3:
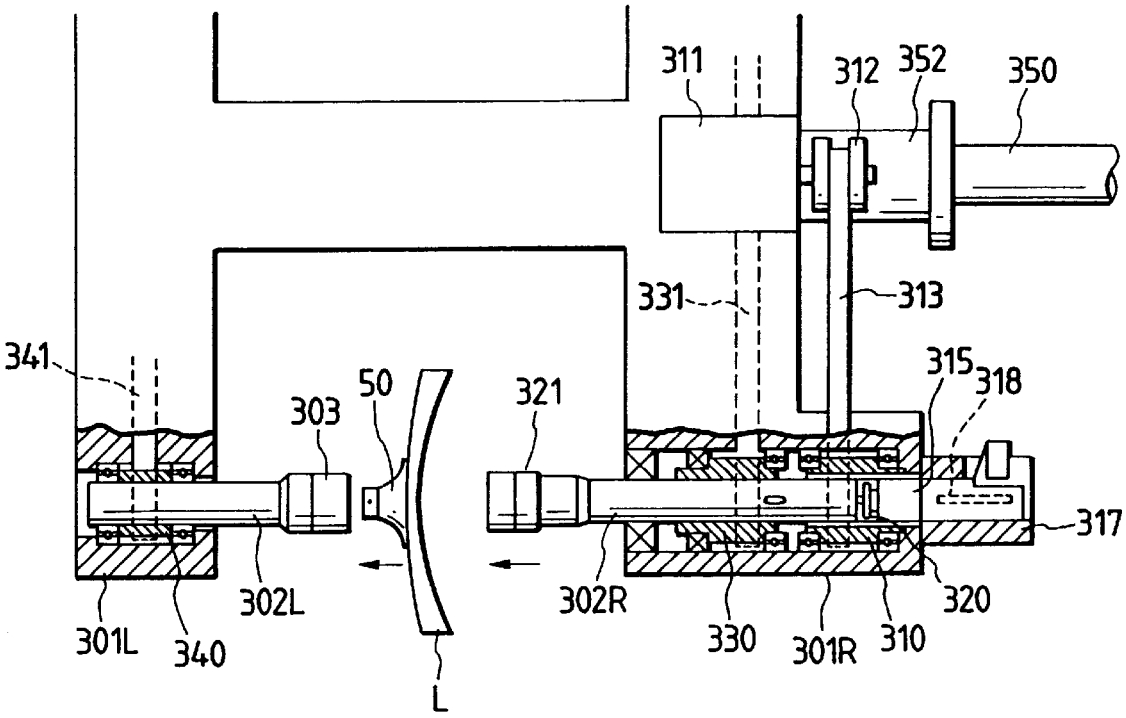
FIG. 3 is a diagram illustrating a lens chuck mechanism.
Figure 4:
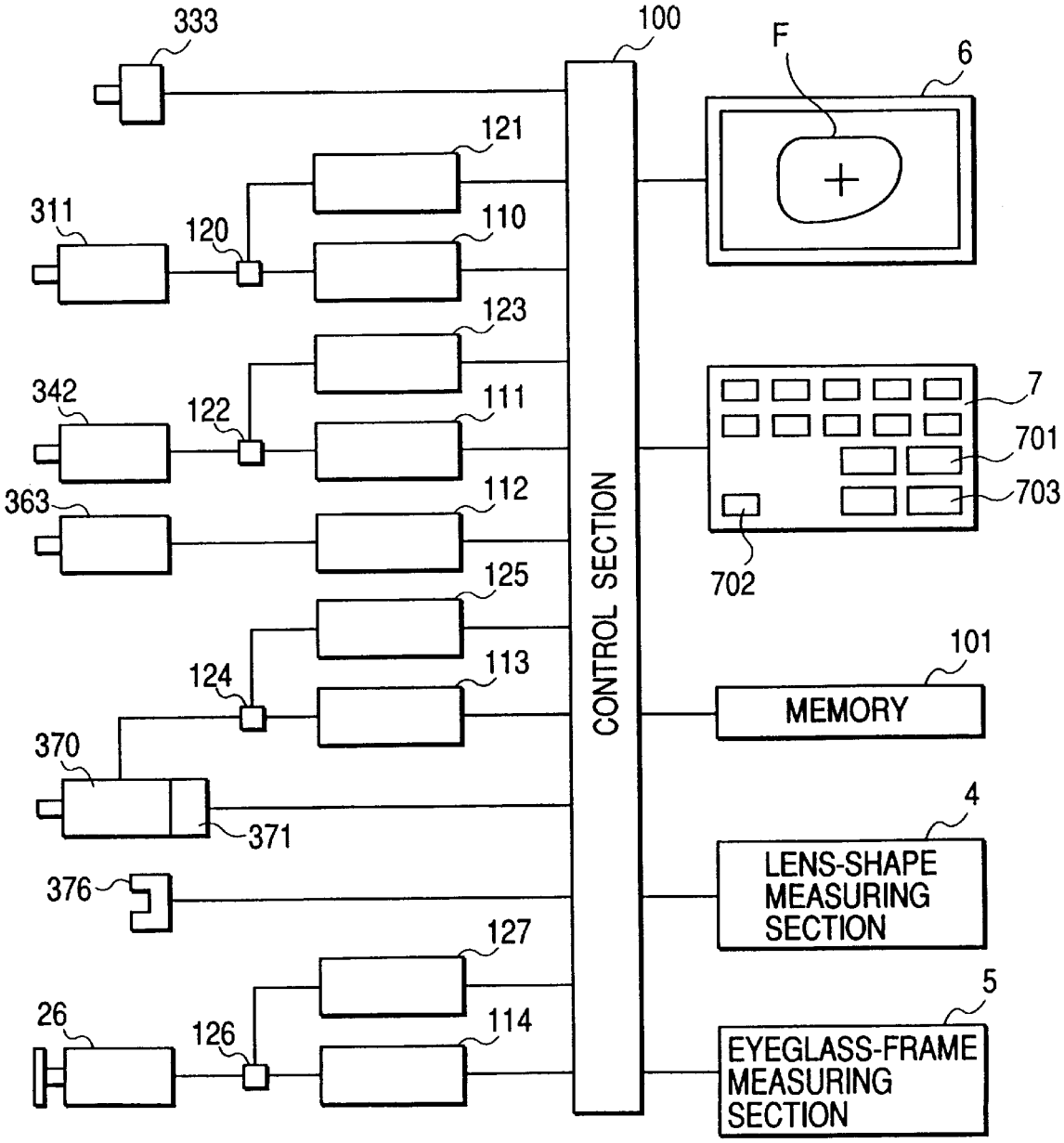
FIG. 4 is a block diagram of essential portions of a control system for the overall apparatus.

Next, a description-will be given of the construction of the major sections with reference to FIGS. 1 to 4. FIG. 2 is a schematic diagram illustrating the construction of the abrasive-wheel rotating section 2 and the carriage section 3. FIG. 3 is a diagram illustrating a lens chuck mechanism. FIG. 4 is a block diagram showing major components of a control system for the overall apparatus.

Abrasive-wheel Rotating Section

The abrasive wheel group 20 includes a rough abrasive wheel 20*a* for glass lenses, a rough abrasive wheel 20*b* for plastic lenses, and a finishing abrasive wheel 20*c* for beveling and plano-processing, and its abrasive-wheel rotating shaft 21 is rotatably held by a spindle unit 22 secured to the base 1. A pulley 23 is attached to an end of the abrasive-wheel rotating shaft 21, and the pulley 23 is linked to a pulley 25 attached to a rotating shaft of an DC motor 26 for the rotation of the abrasive wheel through a belt 24. Consequently, the abrasive wheel group 20 is rotated as the motor 26 is rotated.

Carriage Section

A substantially H-shaped carriage 300 is arranged to chuck and rotate a subject lens (a lens to be processed) L using two lens chuck shafts 302L and 302R. The carriage 300 is rotatable and slidable with respect to a shaft 350 secured to the base 1 and extending in parallel to the abrasive-wheel rotating shaft 21. Hereafter, a description will be given of a lens chuck mechanism, a lens rotating mechanism, a mechanism for moving the carriage 300 along an X-axis and a mechanism for moving the carriage 300 along a Y-axis, by assuming that the direction in which the carriage 300 is moved in parallel to the abrasive-wheel rotating shaft 21 is the X-axis, and that the direction in which the shaft-to-shaft distance between the lens chuck shafts (302L, 302R) and the abrasive-wheel rotating shaft 21 is changed by the rotation of the carriage 300 is the Y-axis.

(a) Lens Chuck Mechanism

As shown in FIG. 3, the left chuck shaft 302L and the right chuck shaft 302R are held rotatably and coaxially by a left arm 301L and a right arm 301R of the carriage 300, respectively. The left chuck shaft 302 is provided with a cup receiver 303 to receive a suction cup 50 aligned and fixed to the lens L, whereas the right chuck shaft 302R is provided with a lens pushing member 321 for depressing the lens L.

A feed screw 310 is rotatably held inside the right arm 301R and located at the rear of the right chuck shaft 302R. A pulley 312 is attached to the shaft of a chuck motor 311 secured to the center of the carriage 300. The rotation of the pulley 312 is transmitted to the feed screw 310 through a belt 313. A feed nut 315 is disposed inside the feed screw 310 to threadingly engage the feed screw 310. The rotation of the feed nut 315 is regulated by a key way 318 formed in a screw guide 317, so that the rotation of the feed screw 310 causes the feed nut 315 to be moved in the chuck shaft direction (i.e. in the X-axis direction). A cup ring 320 is attached to a tip of the feed nut 315 for rotatably connecting the right chuck shaft 302R thereto. Therefore, the right chuck shaft 302R is rotatable, and is moved in the axial direction of the chuck shaft by the feed nut 315. The lens pushing member or lens holder 321 attached to a distal end of the right chuck shaft 302R presses the lens L to chuck the lens in cooperation with the left chuck shaft 302L. The chuck pressure at this time is detected as an electric current flowing across the motor 311, and the chuck pressure is controlled by supplying a current corresponding to a necessary chuck pressure. A current detector 120 detects the electric current flowing across the motor 311, and supplies a detection signal through a signal processing section 121 to a control section 100.

The right chuck shaft 302R is slidably fitted into a pulley 330 rotatably held by bearings. The right chuck shaft 302R is designed to transmit its rotating force to the pulley 330.

(b) Lens Rotating Mechanism

A pulley 340 is attached to the left chuck shaft 302L. This pulley 340 is linked to a pulley 343 of a drive motor 342 which is secured to the rear side of the carriage left arm 301L through a belt 341. When the motor 342 rotates, the left chuck shaft 302L is rotated, and the rotating force of the left chuck shaft 302L is transmitted to the chucked lens L through the cup receiver 303 and the suction cup 50, thereby rotating the lens L. During chucking, since the right chuck shaft 302R is pressed against the lens L through the lens holder 321 as described above, the right chuck shaft 302R is rotated in accordance with and in synchronism with the angle of rotation of the lens L. The rotation of the right chuck shaft 302R is transmitted to an encoder 333, which is attached to the rear of the right arm 301R, through the pulley 330, a belt 331, and a pulley 332, so that the encoder 333 detects the angle of rotation of the right chuck shaft 302R.

In addition, the right chuck shaft 302R may be mechanically coupled so that the right chuck shaft 302R is rotated in synchronism with the left chuck shaft 302L by the rotation of the motor 342.

(c) Mechanism for Moving the Carriage in the X-Axis Direction

A lower central section of the carriage 300 is held by the bearings 351 and 352 rotatably and slidably with respect to the shaft 350 secured to the base 1, and an intermediate plate 360 is rotatably secured to an end portion of the left-side bearing 351. Two cam followers 361 are attached to a rear end of the intermediate plate 360 at a lower portion thereof, and these cam followers 361 nip a guide shaft 362 fixed to the base 1 in parallel positional relation to the shaft 350. Consequently, the carriage 300 can be moved in the lateral direction (X-axis direction) together with the intermediate plate 360 while being guided by the shaft 350 and the guide shaft 362. This movement is effected by a pulse motor 363 for the X-axis movement, which is secured to the base 1. A belt 366 is suspended between a pulley 364 attached to the rotating shaft of the motor 363 and a pulley 365 rotatably supported by the base 1. A linking member 367 for linking the belt 366 and the intermediate plate 360 is secured to the belt 366.

(d) Mechanism for Moving the Carriage in the Y-Axis Direction

A servo motor 370 for the Y-axis movement is fixed to the intermediate plat 360 to rotate the carriage 300 about the shaft 350. The motor 370 has an encoder 371 for detecting the angle of rotation. A gear 372 is attached to the rotating shaft of the motor 370, and the gear 372 meshes with a gear 373 fixed to the bearing 351. Accordingly, the carriage 300 can be rotated about the shaft 350 as the motor 370 is rotatingly driven, thereby making it possible to control the Y-axis movement, i.e. the shaft-to-shaft distance between the abrasive-wheel rotating shaft 21 and the lens chuck shafts (the chuck shafts 302L and 302R). The encoder 371 detects the amount of movement of the carriage 300 in the Y-axis direction on the basis of the angle of rotation by the motor 370. Since the rotational torque of the motor 370 is detected by an electric current detector 124 and a signal processing section 125, the control section 100 controls the rotational torque of the motor 370 through electric power supplied to the motor 370, to thereby prevent an excessive processing pressure applied to the lens L.

A sensor plate 375 is provided in the rear of the left arm 301L of the carriage 300, and as its position is detected by a sensor 376 fixed to the intermediate plate 360, the position of the original point of the rotation of the carriage 300 can be ascertained.

Next, a description will be given of the operation of the apparatus. First, the shape of an eyeglass frame to which a lens is to be fitted is measured by the eyeglass-frame measuring section 5. If a NEXT DATA switch 701 of the input section 7 is pressed, the measured data is stored in a data memory 101, and a target lens shape F is simultaneously displayed on a display of the display section 6. The operator inputs layout data, such as the PD value of the wearer, the FPD value of the eyeglass frame, and the optical center height, by operating the switches of the input section 7. The operator also enters processing conditions including the material of the lens, the material of the frame, and the processing mode, and the like. Upon completion of the entry of the processing conditions, the operator operates a switch 702 to chuck the lens L by driving the motor 311 through a driver 110, and then the operator presses a START switch 703 to start processing. The control section 100 sequentially performs the lens shape measurement and the designated processing in accordance with a processing sequence program on the basis of the inputted data, processing conditions, and the like.

The control section 100 obtains processing radius vector information on the basis of the inputted target lens shape data and layout data (refer to U.S. Pat. No. 5,347,762). Subsequently, the control section 100 measures the shape of the lens L using the lens-shape measuring section 4, and determines whether the lens L can be processed into the target lens shape. The control section 100 drives the motor 342 for lens rotation, the motor 370 for Y-axis movement and the motor 363 for X-axis movement through drivers 111, 113 and 112, to thereby move the lens L to a measuring position. Subsequently, the lens-shape measuring section 4 is operated to obtain shape information based on the processing radius vector information (the construction of the lens-shape measuring section 4 and the measuring operation are basically similar to those described in U.S. Pat. No.

5,347,762). Upon completion of the lens shape measurement, grinding is performed in accordance with the designated processing mode. First, processing starts with rough grinding. The control section 100 moves the carriage 300 using the motor 363 so that the lens L is located above the rough abrasive wheel 20*a* for glass lenses or the rough abrasive wheel 20*b* for plastic lenses depending on the designated lens material. Subsequently, in accordance with rough processing data obtained from the processing radius vector information, the movement of the carriage 300 in the Y-axis direction is controlled in association with the rotational angle of the lens L being rotated, whereby the rough grinding is performed with the lens L being brought into pressure contact with the rough abrasive wheel. The rotational angle of the lens L is detected by the encoder 333, and the amount of the movement of the carriage 300 in the Y-axis direction in association with the rotational angle is detected by the encoder 371. The control section 100 uses these detected values to manage the processed shape of the lens L.

In this manner, the control section 100 moves the carriage 300 in accordance with the processing data, and grinds the lens L by bringing it into pressure contact with the abrasive wheel. During the grinding of the lens L, the chuck shafts are slightly deflected in a direction in which they escape from the abrasive wheel. In a case where the rigidity of the rubber portion of the suction cup 50 is weak, the lens L itself is also slightly distorted in the direction in which it escapes from the abrasive wheel. However, after the carriage 300 is moved to the position of processing completion based on the processing data, the lens L is ground by the abrasive wheel while such deflection and distortion are gradually reduced.

A larger torque (load) acts on the rotation of the abrasive wheel grinding the lens L than the abrasive wheel not grinding the lens L. As the processing is closer to the stage of the completion of processing, the abrasive wheel and the lens are in a state in which they slightly abut against each other, and at the stage of the completion of processing, the abrasive wheel rotates idly. Therefore, when the rotational torque of the abrasive wheel becomes less than or equal to the rotational torque of the abrasive wheel in the idle rotation, it can be judged that the processing of the lens L has been completed. The rotational torque of the abrasive wheel can be known from the electric current flowing across the motor 26. The current flowing across the motor 26 is detected by the current detector 126, and the detection signal is subjected to signal amplification and A/D conversion by the signal processing section 127 and then inputted to the control section 100. The control section 100 ascertains the state of rotational torque of the motor 26 on the basis of the inputted signal, and determines that the processing of the lens L has been completed if the rotational torque has reached a predetermined level or below.

In addition, the determination of the processing completion can also be carried out by monitoring the rotational torque applied to the lens L (lens chuck shaft) being ground by the rotating abrasive wheel. During the processing of the lens L, the driving of the motor 342 for rotating the lens chuck shaft is controlled so that the processing is carried out at a predetermined rotating position on the basis of processing data based on processing radius vector information as well as the angle of rotation detected by the encoder 333. The rotational load applied to the lens L by the abrasive wheel rotated at high speed causes the lens chuck shaft to be slightly rotated. This rotation is detected by the encoder 333, and the control circuit 100 drives the motor 342 so as to return the lens chuck shaft to a predetermined rotating position. At this time, a larger rotating torque is applied to the motor 342 than when the lens L is not being ground (i.e., when the abrasive wheel is in the idle rotation). Accordingly, by monitoring the current flowing across the motor 342 through the current detector 122 and the signal processing unit 123, in the same way as in the detection of the rotational torque of the abrasive wheel, the processing completion can be determined when the rotational torque applied to the lens L has been reached a predetermined level in which the abrasive wheel is in the idle rotation.

As described above, the determination for the processing completion on the basis of the state of the rotational torque of the abrasive wheel or the lens chuck shaft makes the processing accurate, and the processing completion can be determined at an appropriate timing irrespective of the thickness or the hardness of the lens L. This determination for the processing completion is similarly applied to the finish grinding using the finishing abrasive wheel 20*c*.

Figure 5:
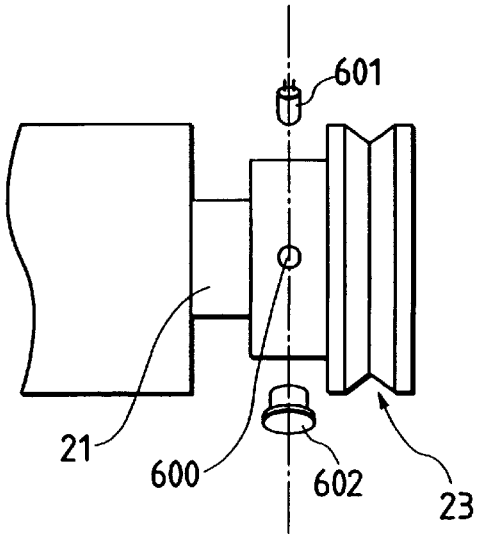
FIG. 5 is a diagram for explaining an example in which the number of rotations of an abrasive-wheel rotating shaft is detected.

In addition, in the case where the processing completion is determined on the basis of the state of rotation of the abrasive wheel rotated at high speed, the state of the rotational load can be recognized not by monitoring the rotational torque but from the number of rotations (rotating speed) of the abrasive wheel, the abrasive-wheel rotating shaft or its rotation transmitting member if an element, such as a DC motor, is used whose number of rotations changes in accordance with a predetermined relationship to the rotational load. For example, as shown in FIG. 5, the number of rotations may be detected as follows: The detecting light is projected from a LED 601 onto the pulley 23 fixed to the abrasive-wheel rotating shaft 21, and a photosensor 602 receives the reflecting light from a detection mark 600 provided on the rotating shaft 21. On the basis of the state of the reception of the reflected light, the number of the rotations is detected.

As described above, in accordance with the present invention, since the completion of processing can be determined appropriately with high accuracy, highly efficient processing can be performed. In addition, it is possible to perform high-accuracy processing since the accuracy in the determination of the completion of processing is improved.

What is claimed is:

1. An eyeglass lens grinding apparatus for grinding a periphery of a lens to be processed, the apparatus comprising:

lens rotating means having two lens rotation shafts for holding and clamping the lens;

abrasive wheel rotating means having an abrasive wheel rotation shaft to which the lens grinding abrasive wheel is attached;

axis-to-axis distance varying means for varying a distance between a rotation axis of the lens rotation shafts and a rotation axis of the abrasive wheel rotation shaft so that an edge of the lens is brought into pressure contact with the abrasive wheel for processing;

detecting means for detecting at least one of a rotational load to at least one of the lens rotation shafts and a rotational load to the abrasive wheel rotation shaft; and judging means that, based on a result of detection by the detecting means, judges completion of lens processing at a rotation angle if the detected rotational load reaches a predetermined level.

2. The eyeglass lens grinding apparatus according to claim 1, wherein:

the lens rotating means includes a lens rotating motor for rotating at least one of the lens rotation shafts;

the abrasive wheel rotating means includes an abrasive wheel rotating motor for rotating the abrasive wheel rotation shaft; and the detecting means detects at least one of a rotational torque of the lens rotating motor and a rotational torque of the abrasive wheel rotating motor.

3. The eyeglass lens grinding apparatus according to claim 2, wherein the detecting means detects at least one of the rotational torque of the lens rotating motor and the rotational torque of the abrasive wheel rotating motor based on at least one of an electric current supplied to the lens rotating motor and an electric current supplied to the abrasive wheel rotating motor.

4. The eyeglass lens grinding apparatus according to claim 1, wherein:

the abrasive wheel rotating means includes a DC motor for rotating the abrasive wheel rotation shaft; and the detecting means includes a photosensor, and detects the rotational load to the abrasive wheel rotation shaft by obtaining at least one of a rotational speed and a rotational number of at least one of the abrasive wheel and the abrasive wheel rotation shaft based on a result of detection by the photosensor.

5. The eyeglass lens grinding apparatus according to claim 1, wherein:

the abrasive wheel rotating means includes a DC motor for rotating the abrasive wheel rotation shaft, and a transmission member for transmitting a rotational torque of the motor to the abrasive wheel rotation shaft; and the detecting means includes a photosensor, and detects the rotational load to the abrasive wheel rotation shaft by obtaining at least one of a rotational speed and a rotational number of the transmission member based on a result of detection by the photosensor.

6. An eyeglass lens grinding apparatus for grinding a periphery of a lens to be processed, the apparatus comprising:

lens rotation shafts that hold and clamp the lens;

a lens rotating device having a lens rotating motor and a first transmission member which transmits a rotational torque of the lens rotating motor to at least one of the lens rotation shafts;

an abrasive wheel rotation shaft to which a lens grinding abrasive wheel is attached;

an abrasive wheel rotating device having an abrasive wheel rotating motor and a second transmission member which transmits a rotational torque of the abrasive wheel rotating motor to the abrasive wheel rotation shaft;

a moving device which causes a relative movement between the lens rotation shafts and the abrasive wheel rotation shaft to vary an axis-to-axis distance between a rotation axis of the lens rotation shafts and a rotation axis of the abrasive wheel rotation shaft, thereby bringing an edge of the lens into pressure contact with the abrasive wheel for processing;

a detector which detects at least one of a rotational load to at least one of the lens rotation shafts and a rotational load to the abrasive wheel rotation shaft; and a controller which, based on a result of detection by the detector, judges completion of lens processing at a rotational angle if the detected rotational load reaches a predetermined level.

7. The eyeglass lens grinding apparatus according to claim 6, wherein the detector detects at least one of the rotational torque of the lens rotating motor and the rotational torque of the abrasive wheel rotating motor.

8. The eyeglass lens grinding apparatus according to claim 7, wherein the detector detects at least one of the rotational torque of the lens rotating motor and the rotational torque of the abrasive wheel rotating motor based on at least one of an electric current supplied to the lens rotating motor and an electric current supplied to the abrasive wheel rotating motor.

9. The eyeglass lens grinding apparatus according to claim 6, wherein:

the abrasive wheel rotating motor includes a DC motor, the detector detects the rotational load to the abrasive wheel rotation shaft by obtaining at least one of a rotational speed and a rotational number of at least one of the abrasive wheel, the abrasive wheel rotation shaft and the second transmission member.

10. The eyeglass lens grinding apparatus according to claim 6, wherein the controller controls operation of the moving device based on the result of detection by the detector.

11. An eyeglass lens grinding apparatus for grinding a periphery of a lens to be processed, the apparatus comprising:

lens rotating means having two lens rotation shafts for holding and clamping the lens and a lens rotating motor for rotating at least one of the lens rotation shafts;

abrasive wheel rotating means having an abrasive wheel rotation shaft to which a lens grinding abrasive wheel is attached, and an abrasive wheel rotating motor for rotating the abrasive wheel rotation shaft;

axis-to-axis distance varying means for varying a distance between a rotation axis of the lens rotation shafts and a rotation axis of the abrasive wheel rotation shaft so that an edge of the lens is brought into pressure contact with the abrasive wheel for processing;

detecting means for detecting at least one of an electric current supplied to the lens rotating motor and an electric current supplied to the abrasive wheel rotating motor;

judging means which judges completion of lens processing at a rotation angle by comparing at least one of a rotational torque of the lens rotating motor and a rotational torque of the abrasive wheel rotating motor, obtained based on a result of detection by the detecting means, with a predetermine rotational torque.

* * * * *